US005880650A

United States Patent [19]

Latouche et al.

[11] Patent Number: 5,880,650

[45] Date of Patent: Mar. 9, 1999

[54] DIELECTRIC RESONATOR FOR A MICROWAVE FILTER, AND A FILTER INCLUDING SUCH A RESONATOR

[75] Inventors: Yannick Latouche; Bernard Theron, both of Toulouse, France

[73] Assignee: Alcatel N.V., Rijswijk, Netherlands

[21] Appl. No.: 644,414

[22] Filed: May 10, 1996

[30] Foreign Application Priority Data

May 12, 1995 [FR] France ..... 95 05672

[51] Int. Cl.[6] ..... H01P 1/208; H01P 7/10

[52] U.S. Cl. ..... 333/202; 333/219.1

[58] Field of Search ..... 333/202, 219.1, 333/208–212, 227–232, 234

[56] References Cited

U.S. PATENT DOCUMENTS

| | | | |
|---|---|---|---|
| 4,489,293 | 12/1984 | Fiedziuszko | 333/202 |
| 5,027,090 | 6/1991 | Gueble et al. | 333/219.1 X |
| 5,172,084 | 12/1992 | Fiedziuszko et al. | 333/219 X |
| 5,200,721 | 4/1993 | Mansour | 333/202 |
| 5,325,077 | 6/1994 | Ishikawa et al. | 333/219.1 |
| 5,710,530 | 1/1998 | Wada et al. | 333/219.1 |

FOREIGN PATENT DOCUMENTS

| | | | |
|---|---|---|---|
| 0064799A1 | 11/1982 | European Pat. Off. . | |
| 63-302601 | 12/1988 | Japan | 333/202 |
| 566280 | 9/1977 | U.S.S.R. | 333/202 |
| 1058014 | 11/1983 | U.S.S.R. | 333/202 |
| 1501197 | 8/1989 | U.S.S.R. | 333/208 |
| 1670728 | 8/1991 | U.S.S.R. | 333/219.1 |
| 1821848 | 6/1993 | U.S.S.R. | 333/208 |

OTHER PUBLICATIONS

A. karp et al, "Circuit Properties of Microwave Dielectric Resonators", *IEEE Transactions on Microwave Theory and Techniques,* vol. 16, No. 10, Oct. 1968, New York, US, pp. 818–828.

W. Zheng, "Direct and inverse resonance problems for shielded coomposite objects treated by means of the null–field method", *IEEE Transactions on Microwave Theory and Techniques,* vol. 37, No. 11, Nov. 1989, New York, US, pp. 1732–1739.

V. Madrangeas et al, "A new finite element method formulation applied to D.R. microwave filter design", *1990 IEEE MTT–S International Microwave Symposium–Digest,* May 8–10, 1990, Dallas, US, pp. 415–418.

*Primary Examiner*—Seungsook Ham

*Attorney, Agent, or Firm*—Sughrue, Mion, Zinn, Macpeak & Seas, PLLC

[57] ABSTRACT

A multimode composite resonator, in particular for a microwave filter, includes a resonant cavity, a dielectric resonator element disposed inside the cavity, a tuning element for each mode and a coupling element for coupling between modes. The resonator element is shaped to have plural vertices which are short-circuited together by the conductive walls of the cavity via direct or RF electrical contact between the vertices and the walls. Various geometrical resonator shapes are possible.

22 Claims, 9 Drawing Sheets

DIELECTRIC RESONATOR FOR A MICROWAVE FILTER, AND A FILTER INCLUDING SUCH A RESONATOR

The invention relates to a microwave multimode composite resonator comprising a resonant cavity, and also to a dielectric resonator element disposed inside the cavity. Such a resonator is of use, in particular in microwave filter devices, since it can be excited by a relatively narrow band only of frequencies around the resonant frequency of said resonator. In order to use such a resonator in a filter, it is necessary also to add means for coupling microwave energy (RF) firstly to inject RF energy into the inlet of said filter and secondly to extract RF energy from the outlet of said filter. Such a filter generally also comprises tuning means enabling the frequency of each main resonant mode of the resonator to be adjusted.

BACKGROUND OF THE INVENTION

Conventionally, a multimode filter also comprises means for coupling energy between modes, said means advantageously being adjustable so as to adjust the transfer of energy between said modes.

One such filter and resonator known in the prior art are described, for example, in patent U.S. Pat. No. 4,489,293 to S. FIEDZIUSZKO, specifically incorporated in the present application for its description of the prior art. In that patent, a filter is constituted by a plurality of composite two-mode resonators disposed in series and coupled together by coupling means, e.g. irises or slots.

The composite resonator of that known device is shown in FIG. 1. It comprises cylindrical pellets 27 of dielectric disposed in a hollow cylindrical cavity 3, 5 with the axes of symmetry of the cavity and of the pellets coinciding.

The cavity is itself of dimensions that are sufficiently small for the intended operating frequency of the composite resonator to be smaller than the cutoff frequency of the cavity in the absence of any dielectric element.

The two-mode filter 1 of the prior art includes two orthogonal modes, and also frequency tuning means for each of these modes, in the present example constituted by tuning screws 29, 31 which project from the walls of the cavity into the inside thereof; these screws are spaced apart on the wall by 90° about the axis of symmetry of the cavity.

In that known device, provision is also made for a coupling screw 33 enabling the transfer of RF energy between the two orthogonal modes to be adjusted, said screw 33 being disposed at 45° to the other two, tuning screws 29, 31.

In spite of the technical and industrial success of the filter disclosed in that prior document, a few practical problems nevertheless remain in its realization and its operation Firstly, it is quite difficult to position the dielectric cylinder internally since it needs to be held by separate holding elements. The assembly must present good reproducibility and good dimensional accuracy, but without that influencing the RF fields present in the resonator in operation.

Secondly, thermal conductivity from the dielectric resonator to the walls is generally poor, since materials having suitable RF characteristics for making the distinct holding elements are not, in general, good conductors of heat.

Thirdly, the prior art filter remains relatively heavy and bulky, in particular for on-board applications such as communications systems on board satellites, aircraft, or mobile platforms-on land or at sea.

OBJECTS AND SUMMARY OF THE INVENTION

An object of the present invention is to provide a multimode composite resonator, in particular for a microwave filter, which is lighter in weight and more compact than are composite resonators of the prior art.

Another object of the present invention is to provide a microwave filter comprising such a composite resonator.

Another object of the invention is to provide a composite resonator having characteristics that lend themselves to simplified industrial realization while conserving optimized operating characteristics. To this end, the resonator of the invention is easier to assemble and to adjust.

These objects, and other advantages which appear below, are achieved by a multimode composite resonator, in particular for a microwave filter, the resonator comprising a resonant cavity and a dielectric resonator element disposed in said cavity;

said cavity being closed at least in part, by means of conductive walls;

said resonator further comprising:

first tuning means for tuning said resonator to a first resonant frequency on a first axis;

second tuning means for tuning said resonator to a second resonant frequency along a second axis orthogonal to said first axis;

mode coupling means to enable resonant energy to be coupled between said first and second axes so that the resonant energy on one of said axes can couple with and thus excite the resonant energy on the other of said axes; and said resonator element is essentially plane, having thickness and an outline;

wherein:

said outline of said resonator element is substantially in the form of a polygon having n sides and n vertices, and wherein said vertices are short-circuited together by the conductive walls of the cavity via electrical or RF contact between said vertices and said walls.

In a preferred embodiment, said polygon is a parallelogram having four sides and four vertices. In an alternative embodiment, said polygon is a triangle having three sides and three vertices.

In various embodiments, said cavity is in the form of a hollow cylinder of section that is rectangular, circular, or square; the resonant element is square, diamond-shaped, or triangular.

In advantageous embodiment, the resonator element includes one or more holes or recesses inside the outline, so as to move parasitic modes away from the vicinity of the desired operating modes, or even eliminate them. In another advantageous embodiment, the same object may be achieved by one or more portions of increased thickness on the inside of the outline.

According to another advantageous characteristic, the resonant element includes a plurality of portions of increased thickness at the vertices of the outline so as to increase thermal conductivity towards the walls of the cavity.

According to another characteristic, the outline includes one or more notches also suitable for use in moving parasitic modes away or for eliminating them, or indeed for effecting coupling between orthogonal modes.

In a preferred embodiment of the invention, a microwave filter includes at least one composite resonator of the invention, together with excitation means, energy extraction means, and coupling means between said resonators if there is more than one resonator. The coupling means may be slots or irises, for example.

BRIEF DESCRIPTION OF THE DRAWINGS

Other characteristics and advantages of the invention appear in the light of the following detailed description of various embodiments, made with reference to the accompanying drawings, in which:

FIG. 8 shows the FIG. 7 dielectric resonator seen end-on;

In all of the figures given by way of non-limiting example showing various embodiments of the invention and some of the main variants thereof, the same references refer to the same elements. The figures are not always to scale for reasons of clarity.

MORE DETAILED DESCRIPTION

Figure 1:
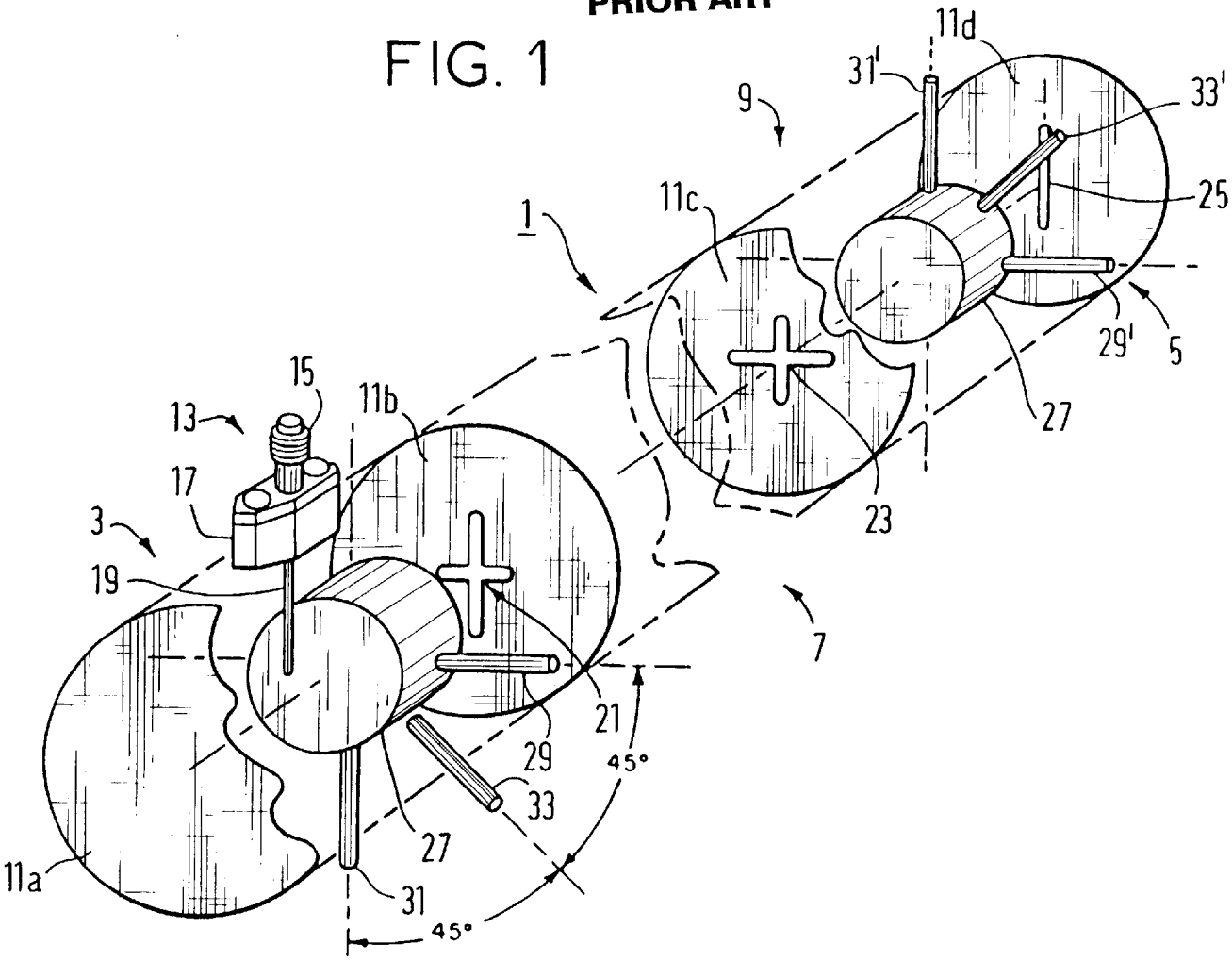
FIG. 1 PRIOR ART
FIG. 1, described above, is a perspective view of a prior art dielectric resonator filter.

FIG. 1, already described above, shows a prior art microwave filter having a composite resonator. The filter comprises an inlet cavity 3, an outlet cavity 5, and optionally one or more intermediate cavities 7, represented diagrammatically by dashed lines and by a discontinuity along the axis of the filter between the cavities 3 and 5.

All of the cavities 3, 5, and 7 are defined electrically inside a length of cylindrical waveguide 9 by means of a plurality of transverse walls 11*a*, 11*b*, 11*c*, 11*d* which close said cavities, at least in part, at each of the two ends of each cavity. The waveguide and the transverse walls are made out of materials that are commonly used by the person skilled in the art for making such devices.

The known filter also comprises a probe assembly 13 used for coupling microwave energy coming from an external source to the inlet cavity 3.

As shown in FIG. 1, the probe 13 comprises a coaxial connector 15, an insulating block 17, and a capacitive probe 19 which penetrates into the inlet cavity 3 in order to excite a resonant mode thereof. In that known filter, the excited mode is a hybrid HE111 mode. Microwave energy is then coupled from the inlet cavity 3 to the optional intermediate cavity(ies) 7 via first coupling means 21 constituted in this case by a first cruciform iris 21; and is then coupled from the optional intermediate cavity(ies) 7 to the outlet cavity 5 via second coupling means 23 constituted by a second cruciform iris 23. Finally, the energy is coupled from the outlet cavity 5 to an external waveguide (not shown), via an outlet iris 25, in this case a single slot.

In each of the cavities 3, 5, and 7, there is disposed a dielectric resonator element 27 made of a material that has a large dielectric constant E, a large Q factor, and a small coefficient of resonant frequency variation as a function of temperature. The resonator element 27 of that known filter is a circular section cylinder as shown in the figure and it is disposed coaxially on the axis of the circular waveguide 9 so as to form a plurality of composite resonators with the successive cavities 3, 5, and 7. These composite resonators are thus circularly symmetrical about said axis of said waveguide 9.

Although not shown in FIG. 1, the resonator elements 3, 5, and 7 are positioned and held in position by insulating mounting means in the form of pellets or columns of insulating material having low dielectric losses, such as polystyrene or PTFE. Such mounting means have numerous drawbacks both during assembly and during operation of the known filter.

Such means increase the number of parts and/or steps in the method of manufacturing the known filter.

The accuracy with which the resonator element is positioned depends on the dimensional accuracy of said means and on the accuracy with which they are assembled. The microwave losses in such materials, although small, are never zero.

In addition to their property of electrical insulation, such materials are generally poor conductors of heat. If the resonator element heats up in operation, e.g. due to microwave losses in the dielectric, the heat generated in this way is relatively difficult to evacuate. RF losses tend to increase with temperature, so this phenomenon runs the risk of becoming worse in operation. An object of the invention is to mitigate those drawbacks In the known filter and also in the filter of the invention, tuning means are provided to tune the modes in each composite resonator. In the filter of FIG. 1, these comprise a first tuning screw 29 which enables a first mode of the first cavity 3 to be tuned. This screw is aligned on a first axis perpendicular to the axis of the cavity 3 and it penetrates into the cavity via the side wall of the waveguide 9. A second tuning screw 31 is provided to tune the resonant frequency of a second mode of the composite resonator; this second screw penetrates into the cavity 3 through a side wall of the waveguide 9 and it extends along a second axis perpendicular to said first axis and to the axis of the cavity 3.

A third tuning screw 33 constitutes coupling means between the two modes which are tuned by said first and second tuning screws 29 and 31. The third screw 33 extends along a third axis at an angle of 45° to each of said first and second axes. This coupling screw 33 serves to vary the coupling of energy between the two orthogonal excitation modes of the composite resonator.

Each cavity 3, 5, 7 in the plurality of cavities of the known filter includes in the same way both means for tuning the two orthogonal modes and means for providing coupling between those two modes.

Also, as shown in FIG. 1, the cavity 5 has its own two tuning screws 29', and 31' together with its own coupling screw 33', where the prime symbol designates the elements of the composite resonator 5.

Further, each cavity is provided with coupling means enabling microwave energy to be injected into and extracted from said cavity. With the exception of probe assembly 13 in the inlet cavity 3, the coupling means are shown in FIG. 1 as being various shapes of slot or iris, however said coupling means could equally well comprise capacitive robes, inductive irises, or a combination of both.

For a more detailed description of the prior art filter, the reader may refer to document U.S. Pat. No. 4,489,293.

Figure 2:
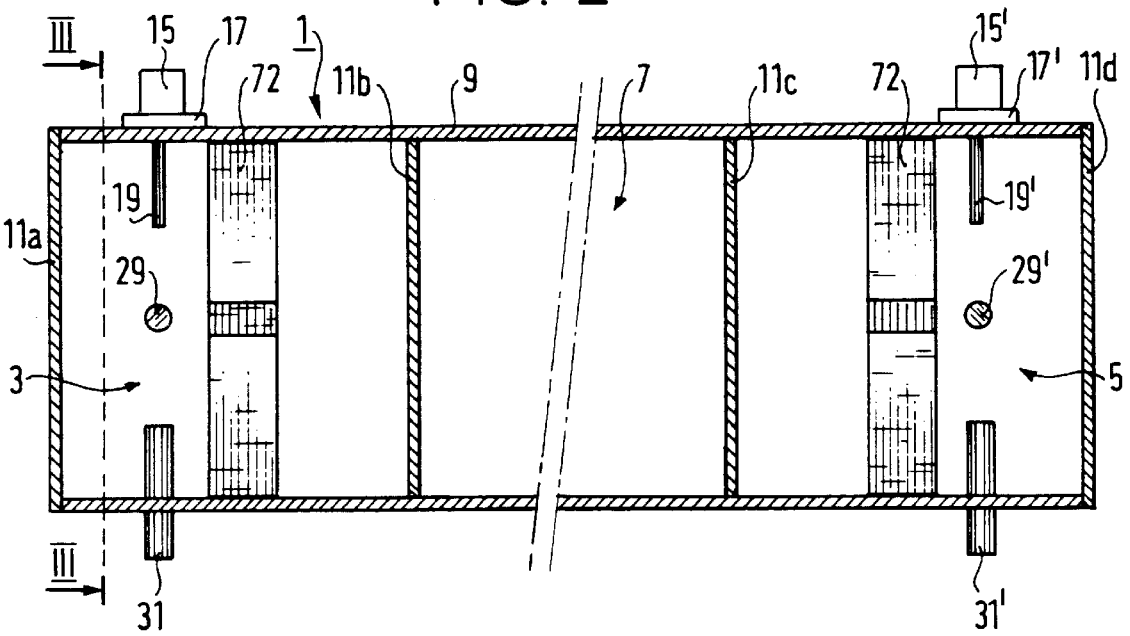
FIG. 2 is a diagrammatic plan view of a microwave multimode filter including a plurality of composite resonators of the invention.

FIG. 2 is a diagrammatic section through a microwave filter comprising a plurality of composite resonators of the invention. To facilitate comparison with the prior art device, the same reference numbers are used, with the exception of the resonator element inside the resonator cavity.

Just like the known microwave filter of FIG. 1, the filter of the invention includes a plurality of composite resonators that are coupled together by coupling means, each composite resonator comprising a resonant cavity and a resonator element 72 inside the cavity. The filter comprises at least one inlet cavity 3 and outlet cavity 5, optionally together with one or more intermediate cavities 7, like the filter of FIG. 1.

Like the filter of FIG. 1, all of the cavities are in alignment on the filter axis and they are at least partially closed at their ends on said axis by walls (11*a*, 11*b*, 11*c*, 11*d*) transverse to said axis, disposed inside a length of waveguide 9 of cylindrical shape about said axis, being of section that is rectangular or circular.

The inlet cavity 3 and the outlet 5 include coupling means (15, 17, 19; 15', 17', 19') serving respectively to couple microwave energy into the inlet cavity 3, or to extract it from the outlet cavity 5.

In an advantageous embodiment of the invention, the composite resonator is excited in a TE mode instead of the HE mode which is preferred for the prior art filter. The use of TE mode makes it possible to obtain a lower resonant frequency for given dimensions. This is an advantage for the compactness of the device at a given operating frequency.

Each of the cavities 3, 5 and 7 contains a dielectric resonator element 72 made of a material having a large dielectric constant E, a large Q factor, and small coefficients of thermal expansion and of variation of resonant frequency as a function of temperature.

In the composite resonator of the invention, the resonator element 72 is essentially plane, as shown in FIG. 2, having a thickness and having an outline in the form of a polygon with n sides and n vertices (where n is an integer greater than 1) which are short-circuited together by the side walls of the cavity (3, 5, 7, . . . ) via electrical or RF contact between the vertices and the walls. The vertices are thus truncated or rounded so as to fit closely to the shape of said side walls, which are plane or circular as the case may be. In the example shown in FIG. 2, the polygon is a parallelogram having four sides and four vertices.

Figure 3:
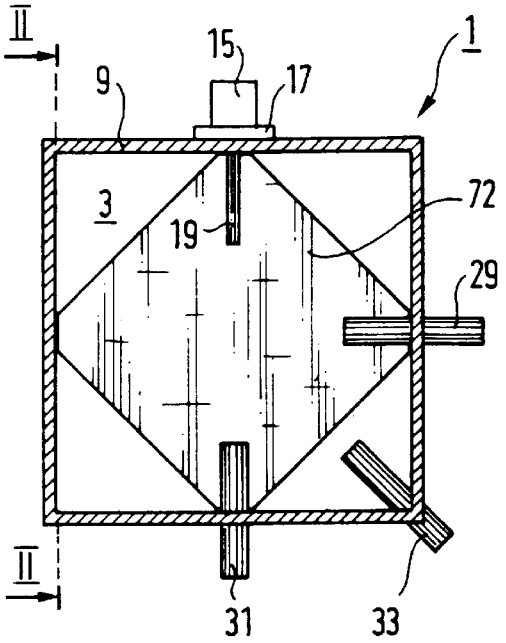
FIG. 3 is a diagrammatic section on III—III through the filter of FIG. 2.

FIG. 3 is a section on III—III through the filter of FIG. 2. It can be seen that the resonator element 72 is square in section in a waveguide 9 that is also square in section. The vertices of the resonator element are truncated so as to fit closely against the plane walls of the waveguide 9. In the example of FIG. 3, the resonator element 72 is in mechanical and electrical contact with the walls of the waveguide 9. Other variants of the invention are described below.

The mechanical contact shown in FIG. 3 enables the resonator element 72 to be positioned exactly and reproducibility inside the resonator cavity that is closed by the waveguide 9 and without calling for the support elements that are necessary in the prior art filter. In addition, the transfer of heat between the element 72 and the walls is considerably improved compared with the prior art.

Also, assembling a filter of the invention as shown in FIG. 3 is considerably simplified compared with the prior art filter of FIG. 1 since positioning is absolute without any help from a plurality of holding pieces as are necessary in the prior art filter.

Because of the reproducibility of assembly and of relative positioning for the resonator element 72 and the walls of the waveguide 9, due to the direct mechanical contact therebetween, adjustment is simplified. The dimensions of the various elements of the filter are designed for such and such an operating frequency, with the possibility of adjusting the frequencies of the various modes of the composite resonator using tuning means provided for this purpose.

One of the advantages of the invention is that the frequencies of the modes are as reproducible as the dimensions and the relative disposition of the various elements involved in manufacturing such a filter.

Figure 4:
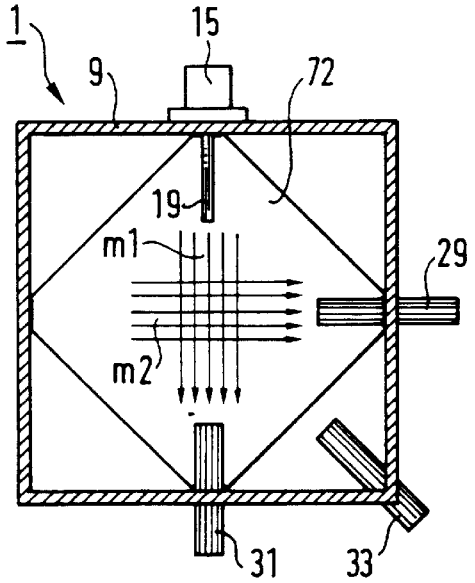
FIG. 4 is a diagram showing the orthogonal TE modes of the dielectrical resonator of FIG. 3.

FIG. 4 is a diagram showing the two orthogonal TE modes (m1, m2) of the FIG. 3 dielectric resonator. It can be seen that these modes are orthogonal merely because of the square shape of the resonator in FIGS. 2 and 3. These orthogonal modes (m1, m2) turn out to be very pure because of the parallelepipedal shape of the dielectric resonator, since the fields are excited and oscillate along the diagonals of the resonator element.

As shown in FIGS. 3 and 4, the mode coupling screw 33 extends along an axis that is at 45° relative to the fields of the two orthogonal modes m1 and m2.

Figure 5:
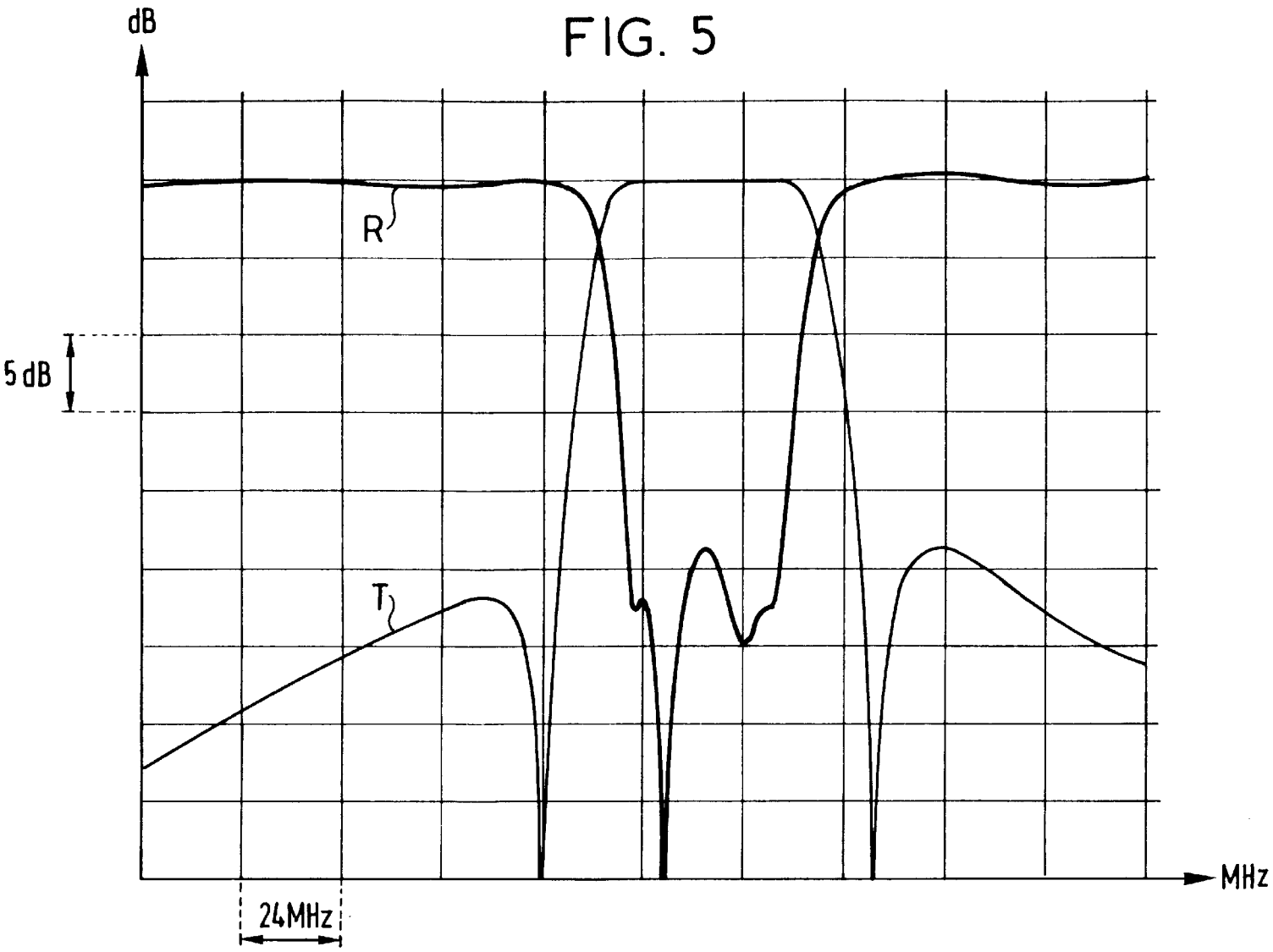
FIG. 5 is a graph showing, superposed, a transmission curve T and a reflection loss curve R both plotted in dB as a function of frequency in MHz.
Figure 6:
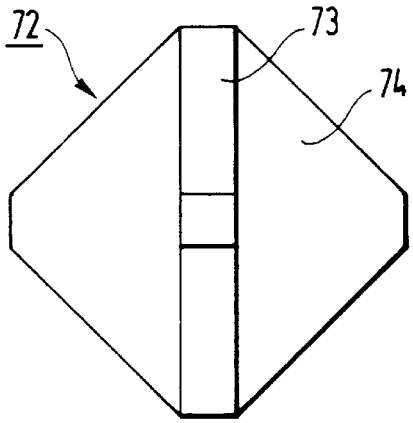
FIG. 6 A diagrammatic side view of a variant dielectric resonator of the invention made by combining two dielectric resonators of the kind shown in FIGS. 3 and 4 at 90° to each other to constitute a three-dimensional resonator.
Figure 8:
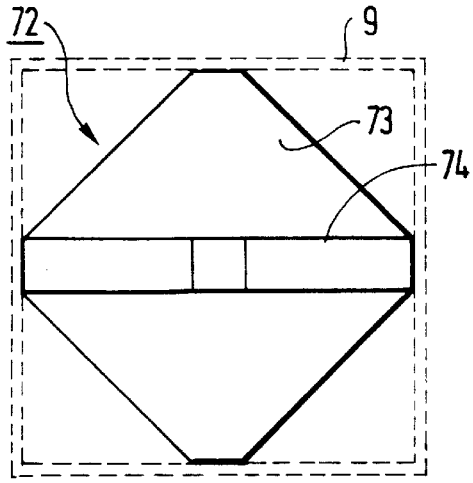
Figure 7:
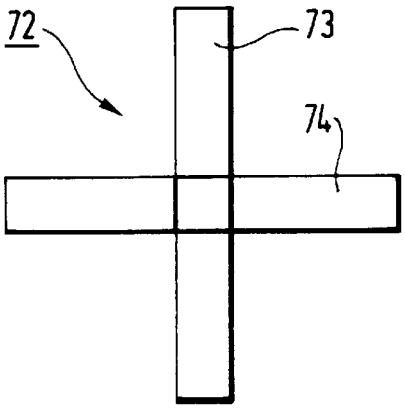
FIG. 7 shows the FIG. 6 dielectric resonator seen from above.
Figure 9:
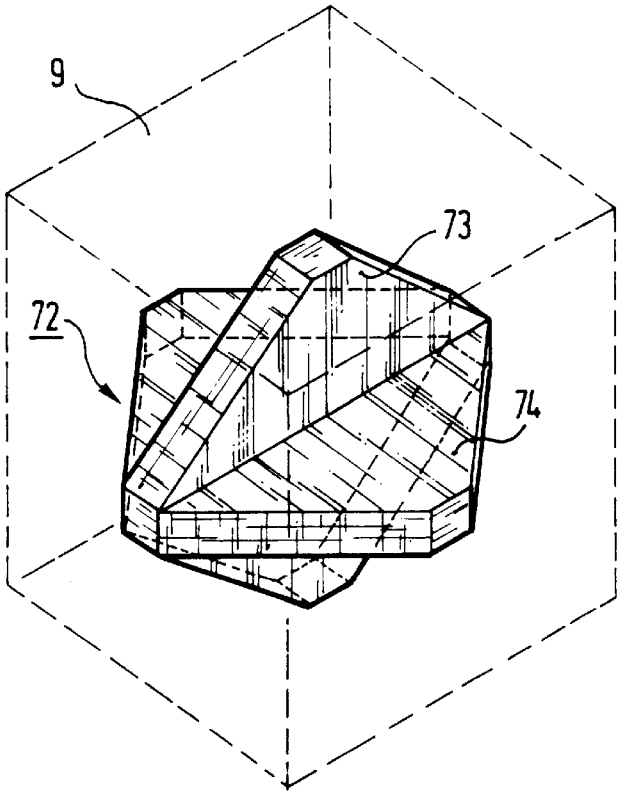
FIG. 9 is a diagrammatic perspective view of the dielectric resonator of the invention as shown in FIGS. 6, 7, and 8.

FIG. 5, obtained from experimental measurements, shows the effectiveness of a four-pole filter of FIG. 2, i.e. a filter having two cavities 3 and 5 and no intermediate cavity 7. Curve T shows the transmission of the filter as a function of frequency giving a bandwidth of 79 MHz at the base and about 50 MHz in the window of maximum transmission. Transmission outside this 79 MHz band is at least 25 dB down, the ordinate being marked in 5 dB intervals. Curve R shows reflection losses as a function of frequency. The filter performance of the filter of the invention is thus clearly demonstrated by measurement.

Several variants of the invention,are described below.

FIGS. 6, 7, 8, and 9 show a three-dimensional resonator element 72 obtained from a resonator 73 as shown in FIGS. 2, 3, and 4 by rotation through 90°, and associated with a similar resonator 74 without rotation.

The resonator 72 of FIGS. 6, 7, 8, and 9 is disposed in a cavity in the form of a cube and is in electrical or RF contact with all six walls of the cube so as to short circuit together all six vertices of said three-dimensional resonator element 72.

FIGS. 10, 11, 12, and 13 show two examples of variants of the invention in which there is no direct mechanical or electrical contact between the vertices of the resonator element and the walls. Nevertheless, RF coupling is provided with the various walls, which constitute a short circuit at the operating frequency.

Figure 10:
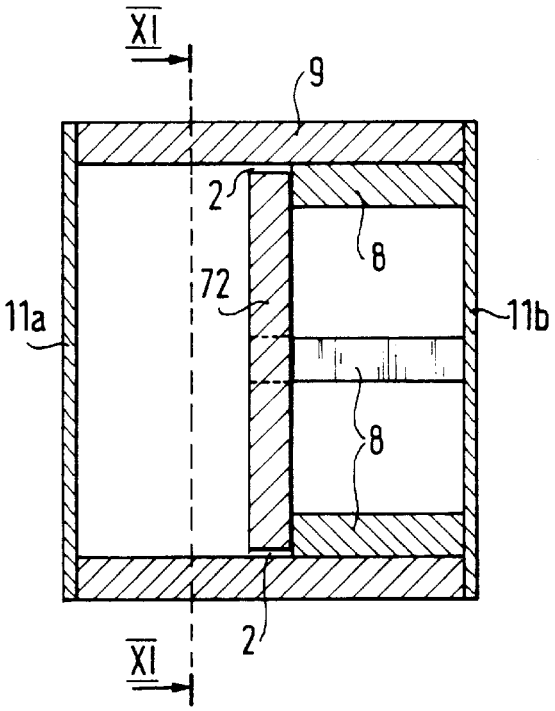
FIG. 10 is a diagrammatic section view of another composite resonator of the invention in which the dielectric resonator is not in mechanical contact with the walls of the resonant cavity, but nevertheless remains in RF short circuit with said walls.
Figure 11:
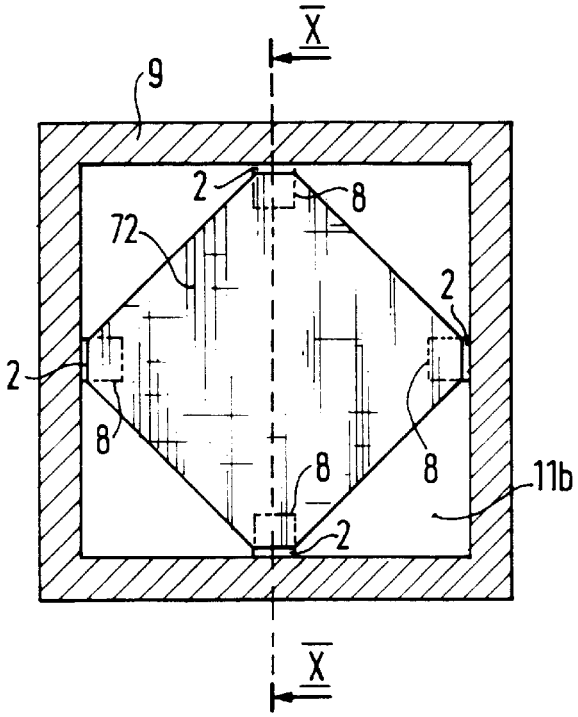
FIG. 11 is a diagram of the FIG. 10 composite resonator in section on XI—XI.

FIGS. 10 and 11 are diagrammatic section views of a variant composite resonator of the invention, with the section of FIG. 10 including the axis of the waveguide 9 and being on section line X—X of FIG. 11, while the section of FIG. 11 is transverse to the axis of the waveguide 9 on section line XI—XI of FIG. 10.

It can be seen that the vertices of the resonator element 72 are truncated so that the dimensions of the element across the diagonals of its outline are slightly smaller than the transverse dimensions of the waveguide 9, thereby leaving a small gap 2 between the resonator element 72 and each of the walls of the waveguide 9. The gap 2 maybe empty, as shown in FIGS. 10, 11, 12, and 13 or it may be filled with a material that is dielectric or conductive. Advantageously, the gap 2 is filled with a resilient material so as to facilitate assembly of the composite resonator and also so as to hold the resonator element over a wide range of temperatures.

In FIGS. 10 and 11, the resonator element 27 is positioned and held by means of holding pillars 8 placed against the walls of the waveguide 9 at locations where the vertices of the resonator element 72 come close to said walls so as to establish an RF short circuit therewith. The pillars may be made of insulating material having low RF losses, e.g. the same materials as those used for holding the resonator element 27 in the prior art filter of FIG. 1.

However, the small volume of the pillars 8 minimizes the losses due to their presence inside the cavity, as compared with the losses due to the holding means in the prior art filter.

In a variant, the holding pillars 8 are of a conductive material. The resonator element 27 is in mechanical and electrical contact with said conductive pillars 8 forming short circuits between the vertices of the resonator element 27 via the walls of the waveguide 9.

Figure 12:
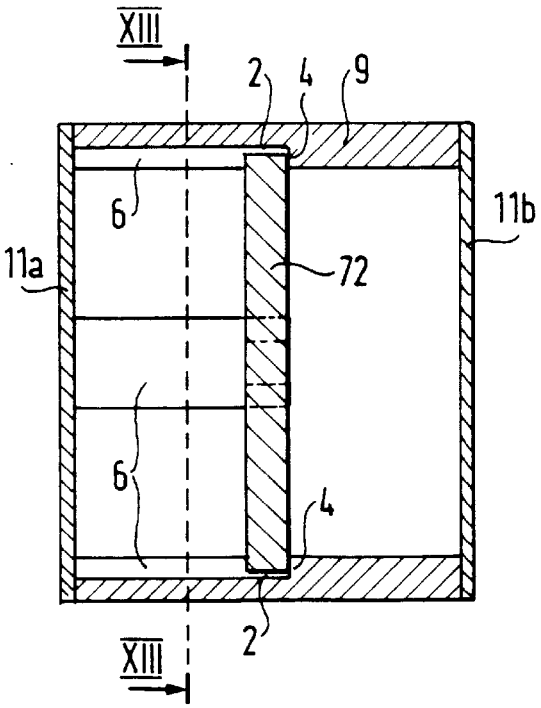
FIG. 12 is a diagram in section of another variant composite resonator of the invention in which the dielectric resonator is in RF contact with the walls but in which the mechanical support of said resonator is provided by notches machined is said walls.
Figure 13:
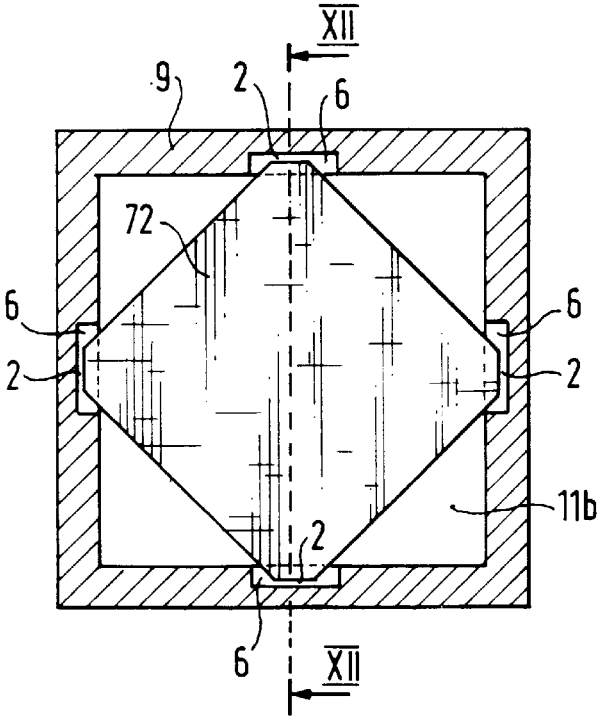
FIG. 13 is a diagrammatic section on XIII—XIII of the composite resonator of FIG. 12.
Figure 14:
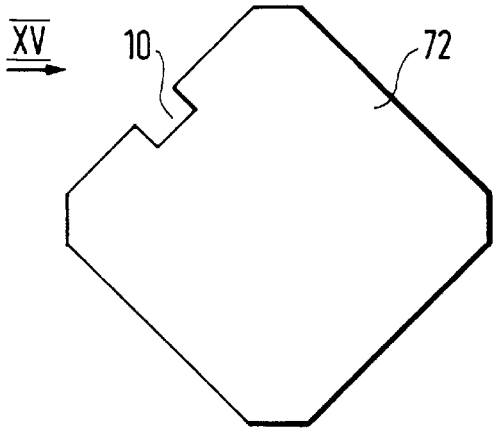
FIG. 14 a diagrammatic plan view of a variant dielectric resonator forming a portion of a composite resonator of the invention and enabling coupling between two orthogonal modes with a limit on the penetration depth of the coupling screw.
Figure 15:
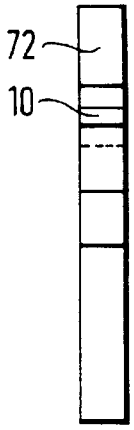
FIG. 15 is a diagrammatic side view of the FIG. 14 resonator.

FIGS. 12 and 13 are diagrammatic sections through another variant composite resonator of the invention, with the section of FIG. 12 including the axis of the waveguide 9 and being on section line XII—XII of FIG. 13, while the section of FIG. 13 is transverse to the axis of the waveguide 9 and on section lines XIII—XIII of FIG. 12.

It can be seen that the vertices of the resonator element 72 are truncated so that the dimensions thereof across the diagonals of its outline are slightly greater than the transverse dimensions of the waveguide 9. In order to enable the resonator element 72 to be inserted in the waveguide 9, notches 6 are formed in the wall of the waveguide 9 at the locations where the vertices of the resonator element 72 come close to said walls so as to enter into RF short circuit therewith. These notches may be made to have sufficient depth so as to leave a small gap 2 between each vertex and the bottom of the corresponding notch 6, as in FIGS. 10 and 11. In the embodiment shown in FIGS. 12 and 13, the resonator element 72 is positioned and held by shoulders 4 formed by making the notches 6 in the walls of the waveguide 9. As in the example of FIGS. 10 and 11, the gaps 2 may be empty or they may be filled with resilient material.

FIGS. 14, 15, 16, 17, 18, and 19 show a few variants of the resonator element that enable various kinds of performance of the composite resonator or of the microwave filter of the invention to be optimized.

In the design of a composite resonator of the invention, the resonant frequencies depend mainly on the dimensions (thickness, transverse dimensions) and on the shape (square, lozenge-shape) of the resonator element 72, and also on the dimensions and on the shape of the resonant cavity in which the resonator element 72 is disposed, and finally on the dielectric material used for making the resonator element.

Figure 18:
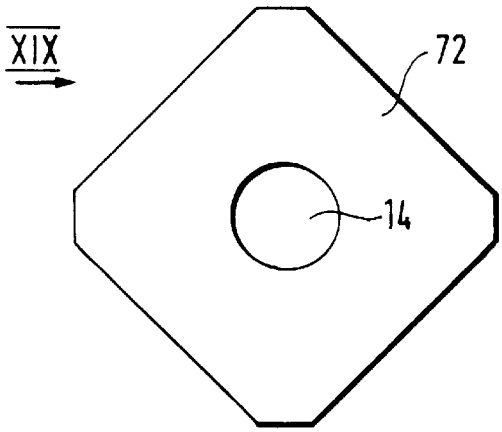
FIG. 18 is a diagrammatic plan view of another variant dielectric resonator of the invention having a void provided in its middle in order to eliminate undesired parasitic modes.
Figure 19:
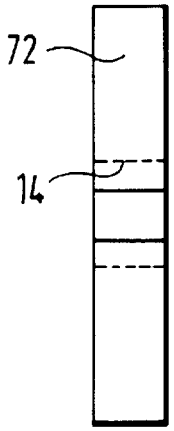
FIG. 19 is a diagrammatic side view of the FIG. 18 resonator.

It can happen that the spectrum of the resonant modes of the composite resonator includes undesired modes that are close (in frequency) to the operating mode(s) of the composite resonator. Under such circumstances, some of the unwanted modes can be moved further away or even eliminated by breaking the exact symmetry of the resonator element shown in the preceding figures, with this being shown in FIGS. 14 and 15. One or more notches 10 of arbitrary shape may be formed at arbitrary locations in the outline of the resonator element 72 for this purpose. In addition, holes 14, recesses, or other variations in thickness can be provided at arbitrary locations within the outline of the resonator element, for the purpose of obtaining the same result. One example is shown in FIGS. 18 and 19.

Figure 16:
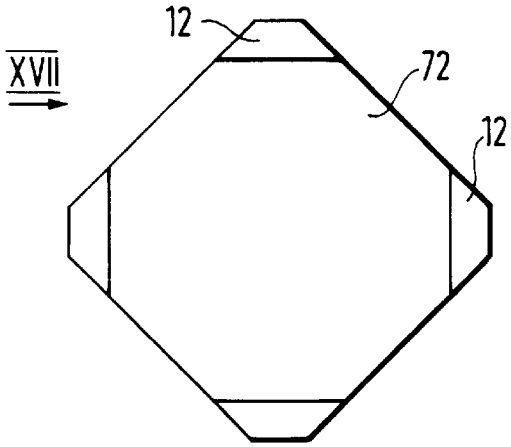
FIG. 16 is a diagrammatic plan view of another variant dielectric resonator of the invention shaped to increase the contact areas between itself and the walls surrounding it.
Figure 17:
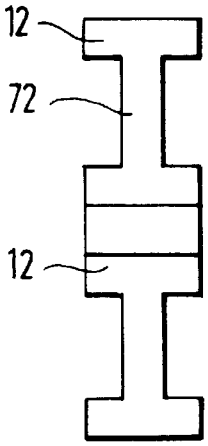
FIG. 17 is a diagrammatic side view of the FIG. 16 resonator.

FIGS. 16 and 17 show portions of increased thickness 12 on the resonator element 72 at the vertices thereof, for the purpose of increasing the thermal conductivity of the dielectric-to-conductor interfaces between the resonator element 72 and the walls of the waveguide 9.

Figure 20:
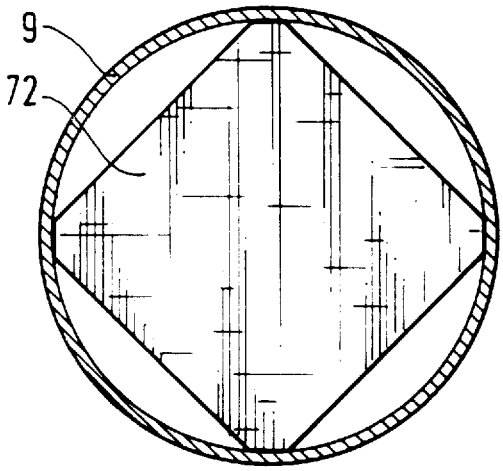
FIG. 20 is a diagrammatic plan view of another embodiment of a composite resonator of the invention comprising a dielectric resonator of substantially square section, inside a resonant cavity of circular section.
Figure 21:
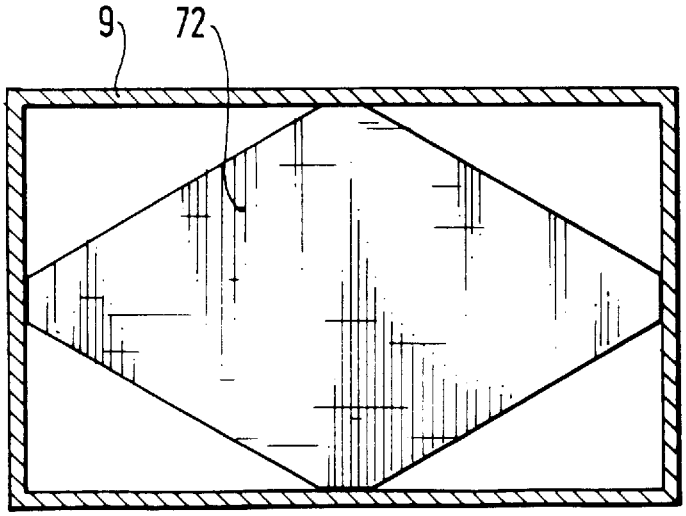
FIG. 21 is a diagrammatic plan view of another embodiment of a composite resonator having a dielectric resonator of section that is parallelogram-shaped inside a resonant cavity of rectangular section.

FIGS. 20 and 21 are diagrammatic cross-sections showing two other variants of the invention relating to the section of the waveguide 9 and also of the resonator element 72. In FIG. 20, the resonator element 72 is square in section and is disposed inside a waveguide 9 that is circular in section. In FIG. 21, a resonator element 72 having a parallelogram or diamond-shaped section is disposed inside a waveguide 9 of rectangular section.

Figure 22:
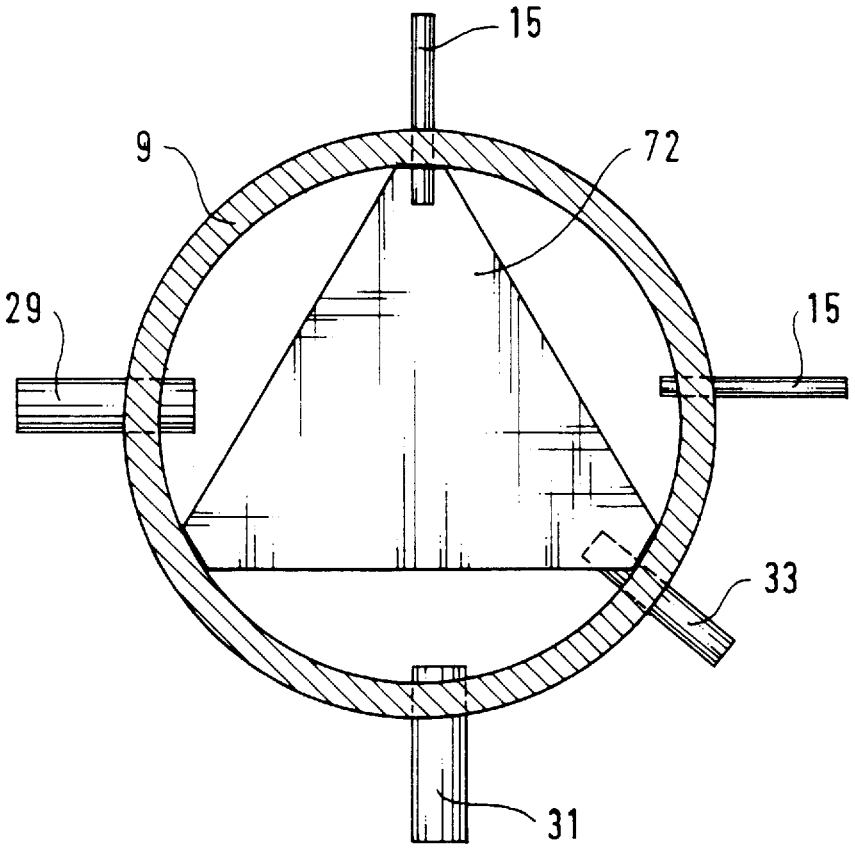
FIG. 22 is a diagrammatic plan view of another embodiment of a composite resonator of the invention comprising a dielectric resonator of substantially triangular section, inside a resonant cavity of circular section.

FIG. 22 shows a diagrammatic plan view of another embodiment of a 2-pole composite resonator of the invention comprising a dielectric resonator 72 of substantially triangular section, inside a waveguide 9 of circular section. The vertices of the resonator element are truncated so as to fit closely against the circular walls of the waveguide 9. As in the example of FIG. 3, the resonator element 72 is in mechanical and electrical contact with the walls of the waveguide 9. Other variants of the embodiment of the FIG. 22 are also possible as described above with reference to FIGS. 10–13.

As in FIGS. 1–4, FIG. 22 also shows two tuning screws 29 and 31 for two orthogonal modes, and the coupling screw 33 which determines the coupling between the modes. As in the other filters previously described, coaxial connectors 15 may be provided to excite the composite resonator.

Figure 23:
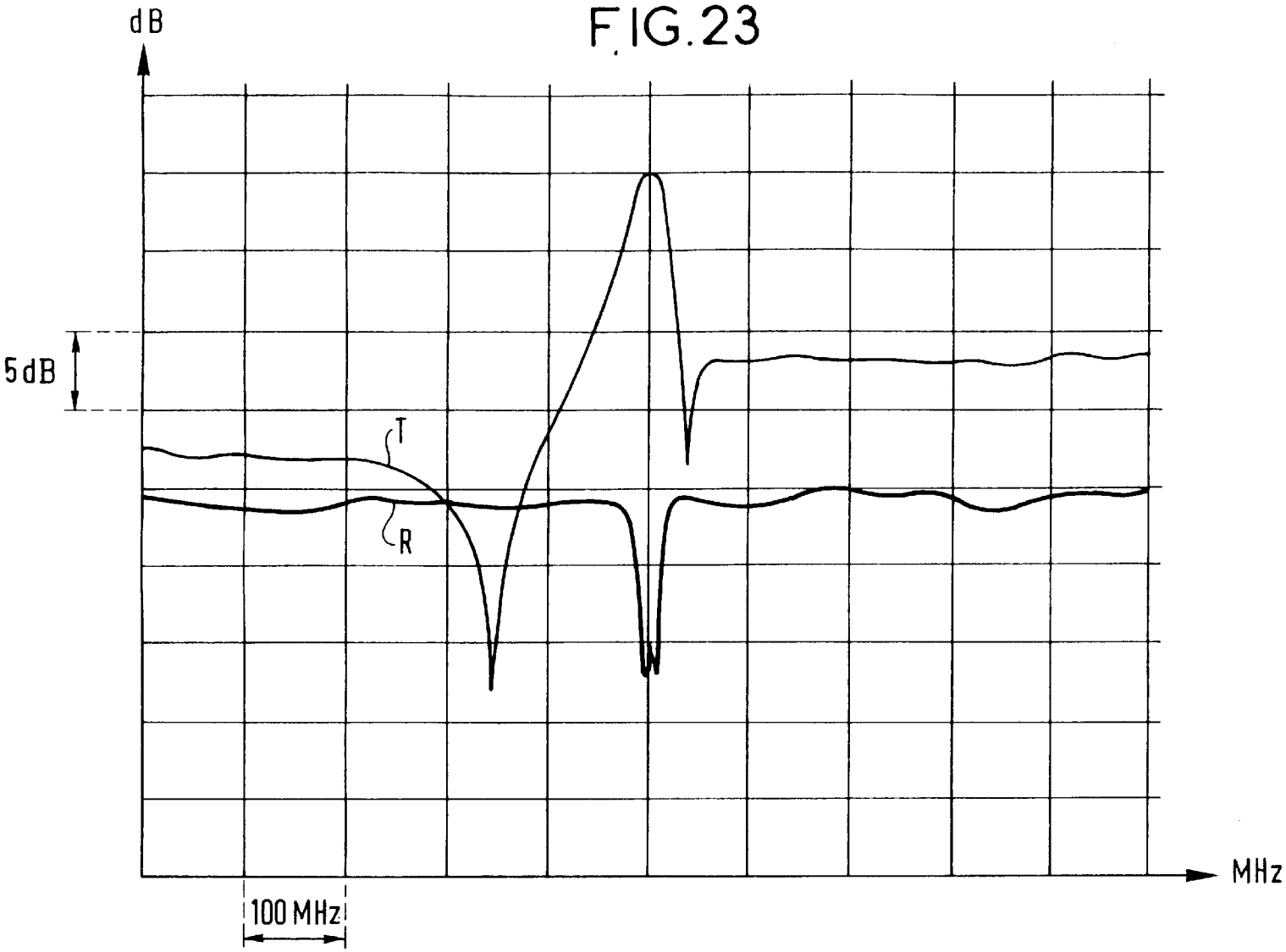
FIG. 23 is a graph showing, superposed, a transmission curve T and a reflection loss curve R for the composite resonator of FIG. 22, plotted in dB as a function of frequency in MHz.

FIG. 23, obtained from experimental measurements, shows the effectiveness of a 2-pole filter of the type shown in FIG. 22. Curve T shows the transmission of the filter as a function of frequency giving a bandwidth of about 100 MHz at the base and about 50 MHz in the window of maximum transmission. Transmission outside this 79 MHz band is at about 15 dB down (±3 dB), the ordinate being marked in 5 dB intervals. Curve R shows reflection losses as a function of frequency. The filter performance of this filter can of course be improved by coupling a plurality of successive composite resonators as in those filters previously described.

The invention is described above, by means of various non-limiting embodiments. The person skilled in the art will be capable of combining various design parameters for composite resonators and microwave filters applying the principles of the invention, without thereby going beyond the ambit of the invention as defined by the following claims.

We claim:

1. A multimode composite resonator, in particular for a microwave filter, the resonator comprising a resonant cavity and a dielectric resonator element disposed in said cavity; said cavity including conductive walls; and said resonator further comprising first tuning means for tuning said resonator to a first resonant frequency on a first axis; second tuning means for tuning said resonator to a second resonant frequency along a second axis orthogonal to said first axis; and mode coupling means to enable resonant energy to be coupled between said first and second axes so that the resonant energy on one of said axes can couple with and thus excite the resonant energy on the other of said axes; and wherein said resonator element has a thickness along a cavity axis orthogonal to each of said first and second axes so that said resonator element is essentially plane, said resonator element further having an outline as viewed along said cavity axis, wherein said outline of said resonator element is substantially in the form of a polygon having n sides meeting to form n vertices, and wherein all of said vertices are short-circuited together by the conductive walls of the cavity via electrical or RF contact between said vertices and said walls.

2. A multimode composite resonator according to claim 1, wherein said polygon is a parallelogram having four sides and four vertices.

3. A multimode composite resonator according to claim 1, wherein said polygon is a triangle having three sides and three vertices.

4. A multimode composite resonator according to claim 1, wherein said cavity is in the form of a hollow cylinder of rectangular section.

5. A multimode composite resonator according to claim 1, wherein said cavity is in the form of a hollow cylinder of circular section.

6. A multimode composite resonator according to claim 4, wherein said cavity is in the form of a hollow cylinder of square section.

7. A multimode composite resonator according to claim 1, wherein said outline of said resonant element is substantially square in shape.

8. A multimode composite resonator according to claim 1, wherein said outline includes at least one notch such that said resonator element is asymmetrical with respect to said cavity axis.

9. A microwave filter comprising at least one multimode composite resonator according to claim 1, and further comprising means for exciting said at least one resonator, together with means for extracting resonant energy from said at least one resonator, and means for providing coupling between said resonators if there are a plurality of resonators.

10. A microwave filter comprising a plurality of multimode composite resonators according to claim 1, and further comprising means for exciting said resonators, together with means for extracting resonant energy from said resonators, and an iris for providing coupling between said resonators.

11. A multimode composite resonator according to claim 1, wherein said cavity is resonant in a TE mode.

12. A multimode composite resonator according to claim 2, wherein said cavity is in the form of a hollow cylinder of rectangular section.

13. A multimode composite resonator according to claim 3, wherein said cavity is in the form of a hollow cylinder of circular section.

14. A multimode composite resonator according to claim 7, wherein said cavity is in the form of a hollow cylinder of square section.

15. A multimode composite resonator according to claim 1, wherein said resonator element has a first portion which is essentially planar in a first plane containing both of said first and second axes, and a second portion which is essentially planar in a plane orthogonal to said first plane.

16. A multimode composite resonator comprising a resonant cavity with conductive walls and resonant along at least first and second axes orthogonal to a cavity axis, and a dielectric resonator element disposed in said cavity; wherein said resonator element has a thickness along said cavity axis which is substantially less than its dimension along at least said first axis such that said resonator element is essentially plane, and wherein said resonator element has an outline as viewed along said cavity axis which is substantially polygonal with n sides meeting to form n vertices, with each side having one of said vertices at each end, where n is an integer greater than 1, all of said vertices being short-circuited together via electrical or RF contact with said cavity walls, wherein said resonator element is asymmetrical with respect to at least one of said first and second axes.

17. A multimode composite resonator according to claim 16, wherein said resonator element has at least one hole or recess within said outline.

18. A multimode composite resonator comprising a resonant cavity with conductive walls and resonant along at least first and second axes, and a dielectric resonator element disposed in said cavity; wherein said resonator element has an outline as viewed along one of said axes which is substantially polygonal with n sides and n vertices, where n is an integer greater than 1, said vertices being short-circuited together at a resonant frequency of said resonator via RF contact with said cavity walls, but not DC short-circuited to said cavity walls.

19. A multimode composite resonator according to claim 18, further comprising a resilient material disposed between said vertices and said cavity walls.

20. A multimode composite resonator comprising a resonant cavity with conductive walls and resonant along at least first and second axes, and a dielectric resonator element disposed in said cavity; wherein said resonator element has an outline as viewed along one of said axes which is substantially polygonal with n sides and n vertices, where n is an integer greater than 1, said vertices extending into recesses formed in said cavity walls.

21. A multimode composite resonator, in particular for a microwave filter, the resonator comprising a resonant cavity and a dielectric resonator element disposed in said cavity; said cavity including conductive walls; and said resonator further comprising first tuning means for tuning said resonator to a first resonant frequency on a first axis; second tuning means for tuning said resonator to a second resonant frequency along a second axis orthogonal to said first axis; and mode coupling means to enable resonant energy to be coupled between said first and second axes so that the resonant energy on one of said axes can couple with and thus excite the resonant energy on the other of said axes; and said resonator element is essentially plane, having a thickness and an outline, wherein said outline of said resonator element is substantially in the form of a polygon having n sides and n vertices, and wherein said vertices are short-circuited together by the conductive walls of the cavity via electrical or RF contact between said vertices and said walls, said resonator element including a plurality of portions of increased thickness at said vertices.

22. A multimode composite resonator comprising a resonant cavity with conductive walls and resonant along at least first and second axes, and a dielectric resonator element disposed in said cavity; wherein said resonator element has an outline, as viewed along a cavity axis, which is substantially polygonal with n sides and n vertices, where n is an integer greater than 1, said vertices extending into recesses formed in said cavity walls;

wherein said vertices are short-circuited together at a resonant frequency of said resonator via RF contact with said cavity walls, but not DC short-circuited to said cavity walls, said resonator further comprising a resilient material disposed between said vertices and an interior of said recesses.

* * * * *